United States Patent [19]

Louis

[11] 4,437,196

[45] Mar. 20, 1984

[54] SUPPORT DEVICE FOR HELPING A PERSON TO GET OUT OF A BATHTUB

[76] Inventor: Pierre A. G. Louis, 38, Rue Ginoux, 75015 Paris, France

[21] Appl. No.: 369,285

[22] Filed: Apr. 16, 1982

[30] Foreign Application Priority Data

Oct. 14, 1981 [FR] France ..... 81 19296
Jan. 4, 1982 [FR] France ..... 82 00022

[51] Int. Cl.[3] ..... A47K 3/12

[52] U.S. Cl. ..... 4/564; 4/566; 4/576; 4/577

[58] Field of Search ..... 4/565, 566, 576, 577, 4/578, 579, 254, 564, 561, 559

[56] References Cited

U.S. PATENT DOCUMENTS

| | | | |
|---|---|---|---|
| 1,827,575 | 10/1931 | Germershausen | 4/576 |
| 1,934,117 | 11/1933 | Daley et al. | 4/565 |
| 2,059,171 | 10/1936 | Harris | 4/576 |
| 2,572,615 | 10/1951 | Hansen | 4/576 |
| 2,817,095 | 12/1957 | Jeffries | 4/576 |
| 3,228,038 | 1/1966 | Augustine | 4/576 |
| 3,311,930 | 4/1967 | Bourke | 4/566 |
| 3,473,174 | 10/1969 | Cool | 4/254 |
| 4,144,597 | 3/1979 | Guenther et al. | 4/254 |
| 4,168,552 | 9/1979 | Austin | 4/564 |
| 4,254,517 | 3/1981 | Herman, Jr. | 4/564 |

FOREIGN PATENT DOCUMENTS

| | | | |
|---|---|---|---|
| 2738310 | 1/1979 | Fed. Rep. of Germany | 4/524 |
| 2265334 | 4/1974 | France | 4/524 |

*Primary Examiner*—Henry K. Artis
*Attorney, Agent, or Firm*—Pollock, Vande Sande & Priddy

[57] ABSTRACT

The invention concerns a support device for helping a person to get out of a bathtub.

According to the invention, the device includes at least one jack (11) for water supply and at least one handle (13) set in motion by said jack which can be lifted when the jack is supplied under pressure between a first low position for which the person resting in the bathtub can take hold of the handle and hang onto it and a second high position for which the person is more or less aided and supported by the handle.

The invention concerns especially aid to old or handicapped persons.

18 Claims, 14 Drawing Figures

SUPPORT DEVICE FOR HELPING A PERSON TO GET OUT OF A BATHTUB

This invention concerns a support device for helping a person to get out of a bathtub. Its utilization is especially recommended for old or handicapped people and especially for people living alone who, practically speaking, cannot take a bath without falling and bringing on disastrous consequences at the time when the person wishes to get out of the bathtub.

In order to facilitate exit out of the bathtub, a handle is sometimes designed to be affixed at the mid-level point of a person's height onto the wall which borders the wide side of the bathtub, or else two elbow rests on the inner sides of the bathtub. Those devices already represent substantial aid to a person that has no more developed athletic capabilities which enable him or her to get up more easily in a slippery environment.

Soap, bath oils and foams, and soft water also increase the difficulties. Statistics show that actually, many people, especially old and handicapped, are the victims of serious falls when coming out of their bathtub.

One knows that, in order to help a person in distress, one takes that person's hand, and pulls it towards oneself. The support device which is the subject of this invention meets this principle and enables an old or handicapped person to exit alone from the bathtub, without harm, whenever desired. Furthermore, the device which is the subject of this invention is of a simple and reliable design and can be adapted to any bathtub at low cost. Ultimately, the bathtub can be specially equipped and arranged to accommodate such a support device.

The perfected device according to the invention can also be used to help a person to enter into a bathtub, and also, to get out of bed or to go to bed, to rise from a seat or to sit down, especially for using a toilet seat.

The support device according to the invention is characterized in that it includes at least one water supply jack and at least one handle or a harness activated by said jack, which can be lifted by the action of said jack when it is supplied under pressure, between a first low position for which the person resting in the bathtub can seize said handle or hang on to said harness, and a second high position for which the person is more or less standing and is supported by said handle or said harness. Preferably, the jack is supplied under pressure by supply water from the bathtub.

One understands that such a device operates very reliably and can be installed very easily onto a bathtub which is automatically supplied with water under flows and pressures that are perfectly compatible with a sound operation of the jack for the sought utilization.

Fortunately, the supply and pressurization of the jack are controlled from the handle or said harness of the device, in such a way so that, as soon as the person takes hold comfortably of the handle or the harness, the device is automatically activated, thus assisting efficiently the person who wishes to rise and exit from the bathtub.

According to an implementation mode, the handle or harness is mounted onto the tip of a lever of which the other tip is attached to the rotating axis of a second lever controlled in a rotation motion while articulated at a particular distance from said axis to a first tip of said jack of which the other tip is articulated in a static point. In this way, the device can be easily withdrawn in a non-use position, completely clearing the use of the device: bathtub, toilet seat or bed to which it facilitates access.

According to another characteristic of the improvements of the invention, said jack and said second lever are articulated respectively around said static axes onto a support and attachment plate of the entire device. Thus, the device can be easily affixed onto a side, like a wall, adjacent to the device for which it facilitates access, the device being integrated if not embedded onto or inside the side to which it is affixed.

The invention and its implementation will appear more clearly with the description which follows, provided as reference to the attached plates in which.

Figure 7:
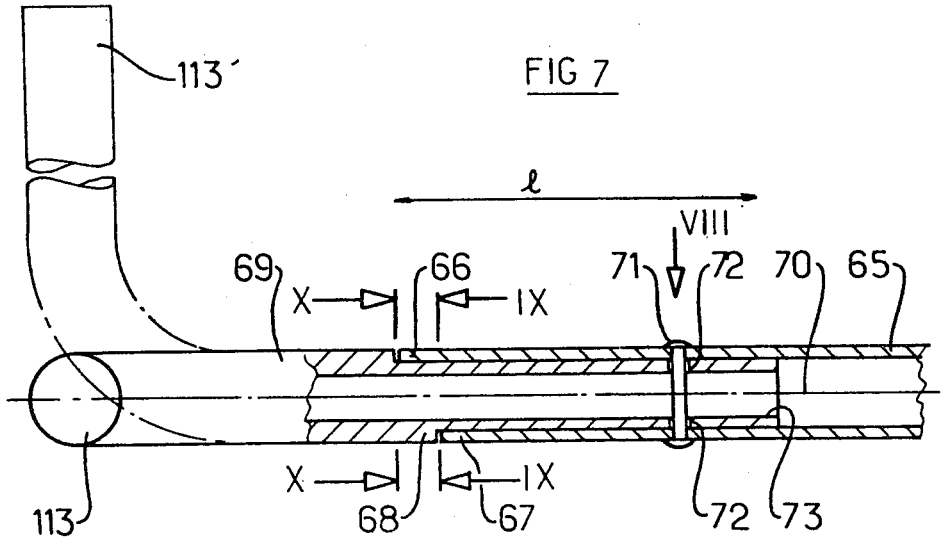
FIG. 7 represents an axial section view of the tip of the lever to which the handle is affixed.
Figure 8:
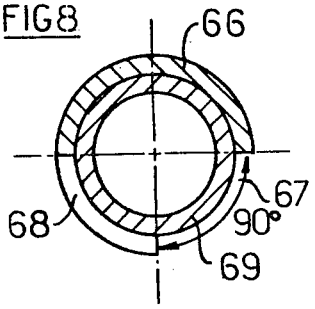
Figure 9:
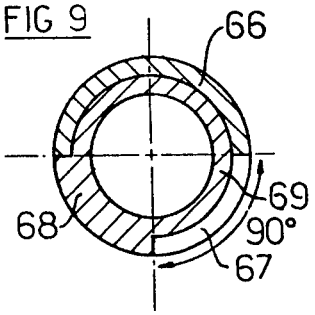
Figure 10:
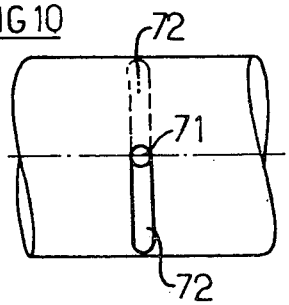
Figure 11:
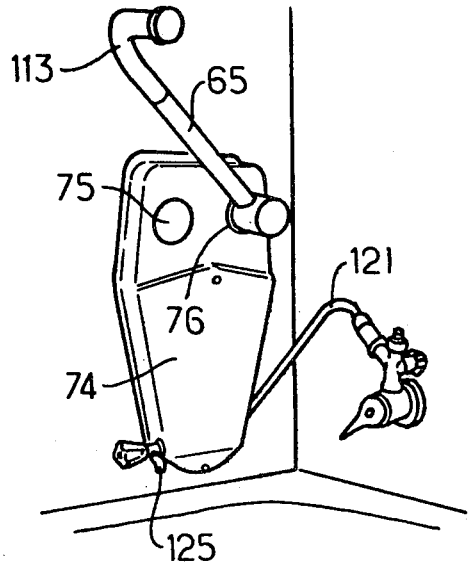
Figure 12:
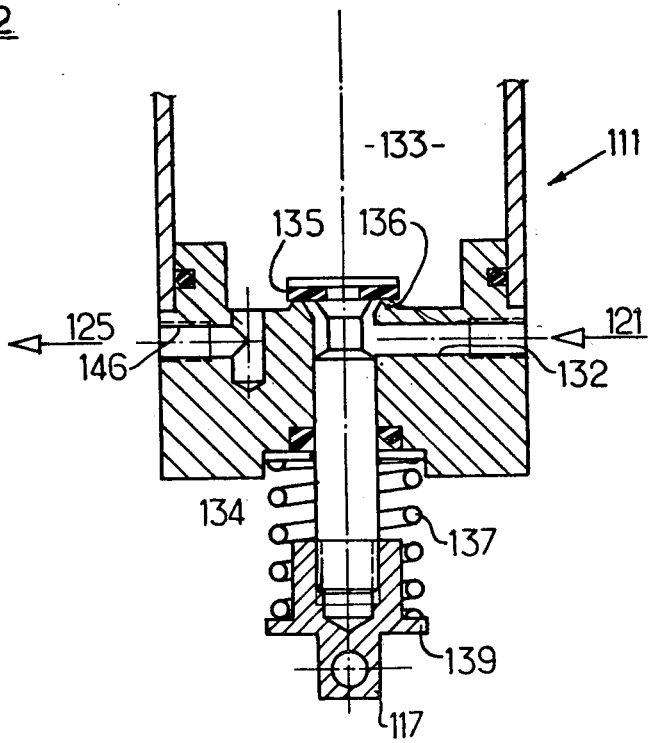
Figure 13:
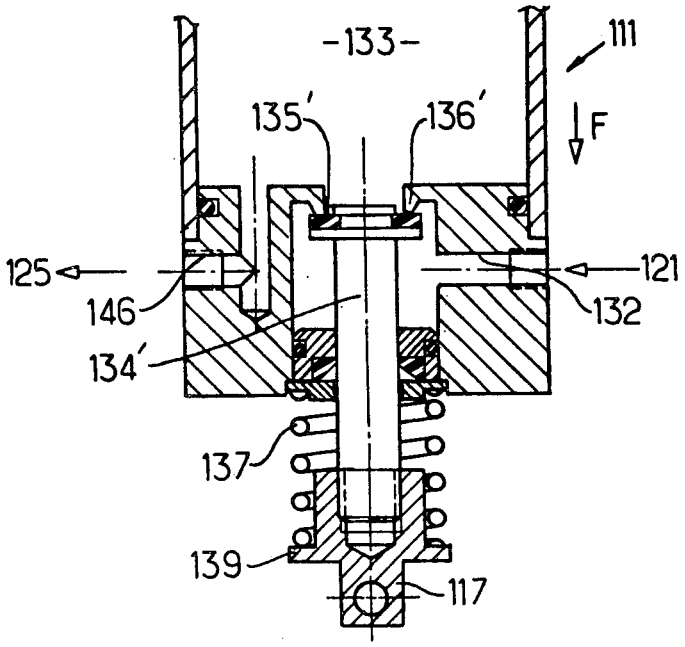
Figure 14:
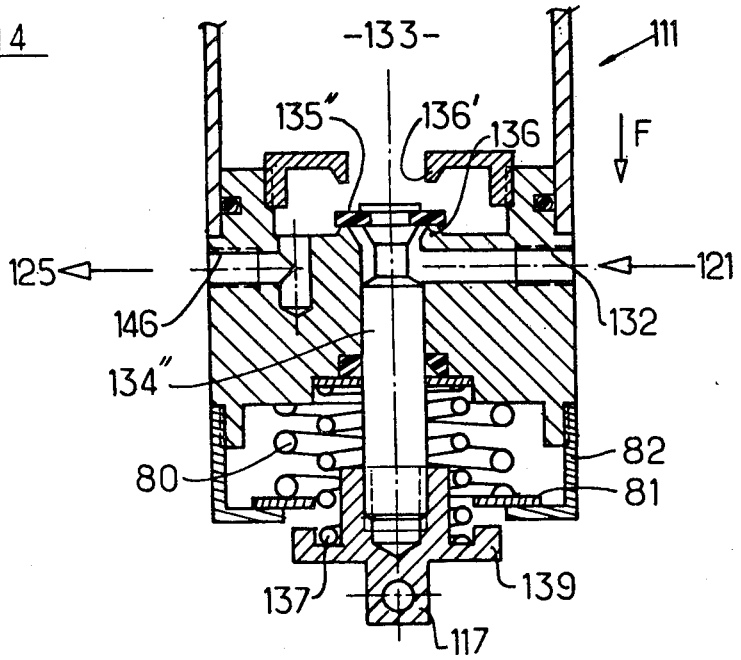

FIGS. 8, 9, and 10 are detailed views performed respectively according to arrow VIII and section planes IX—IX and X—X of FIG. 7;

FIG. 11 represents an outside view of the appearance of the device covered by its protective hood;

FIGS. 12, 13, and 14 are section stripped views at the level of the water supply tip of the jack corresponding to three different implementation modes.

Figure 1:
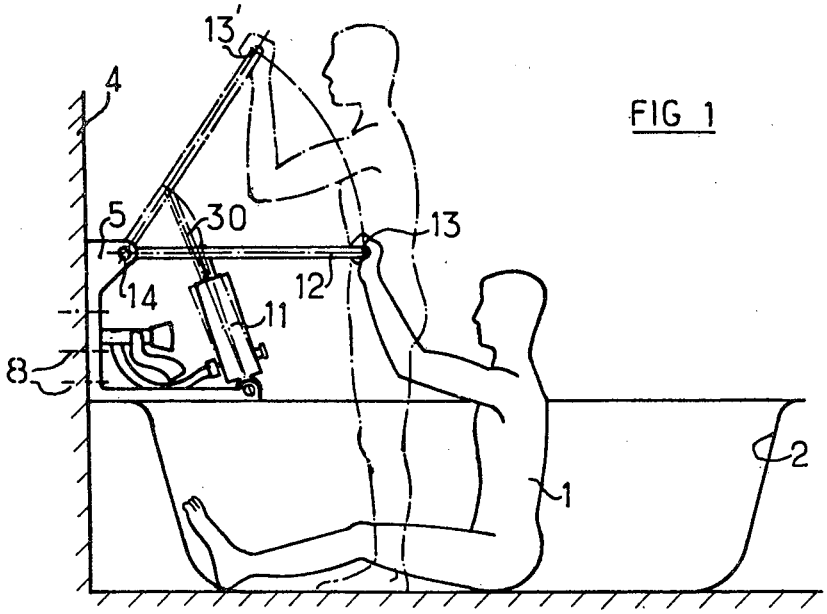
FIG. 1 represents a schematic view of the entire device according to the invention and the way in which it can be utilized to help a person exit from the bathtub.
Figure 2:
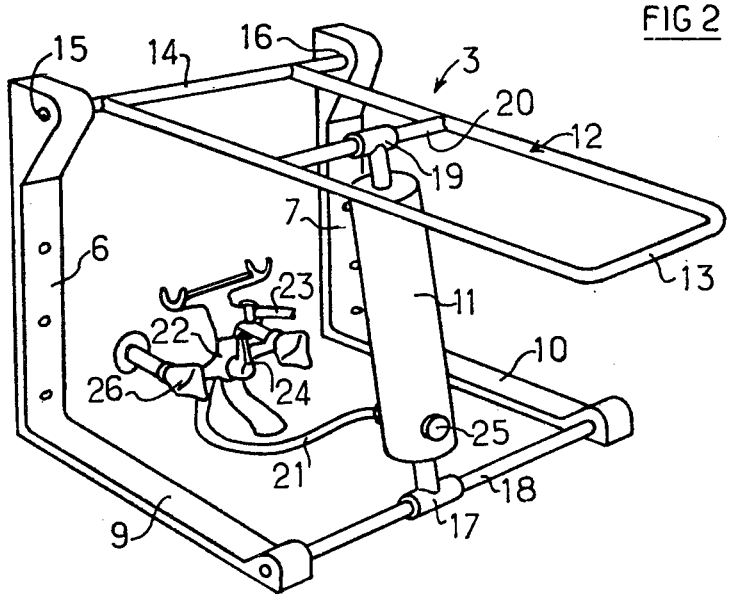
FIG. 2 represents a view in perspective of the entire device visible in FIG. 1.

By referring firstly to FIG. 1, a person 1 is shown in a sitting position, chest raised, inside the bathtub 2. The support device according to the invention indicated as unit 3 is affixed, in the illustrated implementation mode, onto the wall 4 against which the stand tip of the bathtub 2 is leaning. The device 3 is comprised basically, as it appears more clearly in FIG. 2, of a chassis 5 with two vertical arms 6, 7 which are affixed to the wall 4 with screws 8 and including two horizontal arms 9, 10 of a jack 11 and of a mobile frame 12 including a handle 13. The mobile frame 12 is articulated around an axis 14 in two steps 15, 16 shaped towards the tips of the arms 6, 7. The jack 11 is articulated at one of its tips 17 onto an axis 18 affixed to the tips of the arms 9, 10 of the chassis 5. At its other tip, the jack is articulated at 19 onto a cross-bar 20 of the articulated frame 12.

The jack 11 can be supplied with water from a flexible pipe 21 plugged onto the water supply 22 of the bathtub, for instance on the supply by-pass of the shower 23. In the implementation mode illustrated schematically on FIG. 2, a lever 24 can hold three positions, either for faucet supply of the bathtub, shower supply, or flexible pipe supply 21. In a simpler implementation, the shower can be omitted and the lever 24 can hold only two positions, either faucet supply for the bathtub, or jack supply.

Finally, the device is complete with a flap or valve 25 at the base of the jack 11, enabling it to empty.

The operation of the device as described can now be explained.

The person in the bath who wants to get out of it goes into a seated position, as illustrated in 1 by a solid line in FIG. 1.

If the handle 13 of the device is lifted, for instance in position 13' as illustrated in dotted lines, as a result of the extension of the jack, first of all, the person empties or purges the jack 11 by activating the emptying valve 25. The jack is emptied in the bathtub and the mobile frame is lowered to stay in the low position illustrated with the solid line at 12 in FIG. 1. In that position, the person can take hold easily of the handle 13.

In that position, the person then fills the jack with water under pressure, by carefully placing the lever 24 in the jack supply position and opening for instance the cold water supply faucet 26 of the bathtub. Fortunately, the filling of the jack with water 11 takes place, at the request of the person, only when that person is leaning sufficiently on the handle 13 for instance with a device such as the one that will be described further in function of FIGS. 3 and 4. Such an automatic opening controlled from the handle also facilitates the output motion of the bathtub. Since water is admitted under pressure in the jack 11, it relaxes and therefore lifts the handle 13 slowly and gradually from the position illustrated in a full line in FIG. 1 up to the lifted position illustrated in dotted lines in 13' in that same figure. Simultaneously, the person therefore is pulled and lifted by the handle 13 in a more efficient and gradual way than that person would have been by someone else who attempted to help him or her.

One will observe that the lifting thrust can be adjusted by selecting the articulation point 19 of the lever on the frame 12, from the selection of the water supply pressure to the jack and of the jack working section.

In the example illustrated in FIG. 1, the articulation point 19 is located close to the middle of points 13 and 14, the strength of the jack is therefore divided by 2 at the level of the handle 13. If the water supply pressure is 3 bars, one realizes that for inner diameters of the jack of about 4, 5 or 6 centimeters, one obtains lifting forces at the jack of 38, 74, or 84 kilograms respectively. Fortunately, one will place at the jack supply input a check-valve which prevents a brutal emptying of the jack in the event of a break in the flexible supply pipe 21 and ultimately a pressure reducer which will also enable one to adjust and maintain, at a constant jack supply pressure independently of the supply pressure, fluctuations of the distribution channeling.

Figure 3:
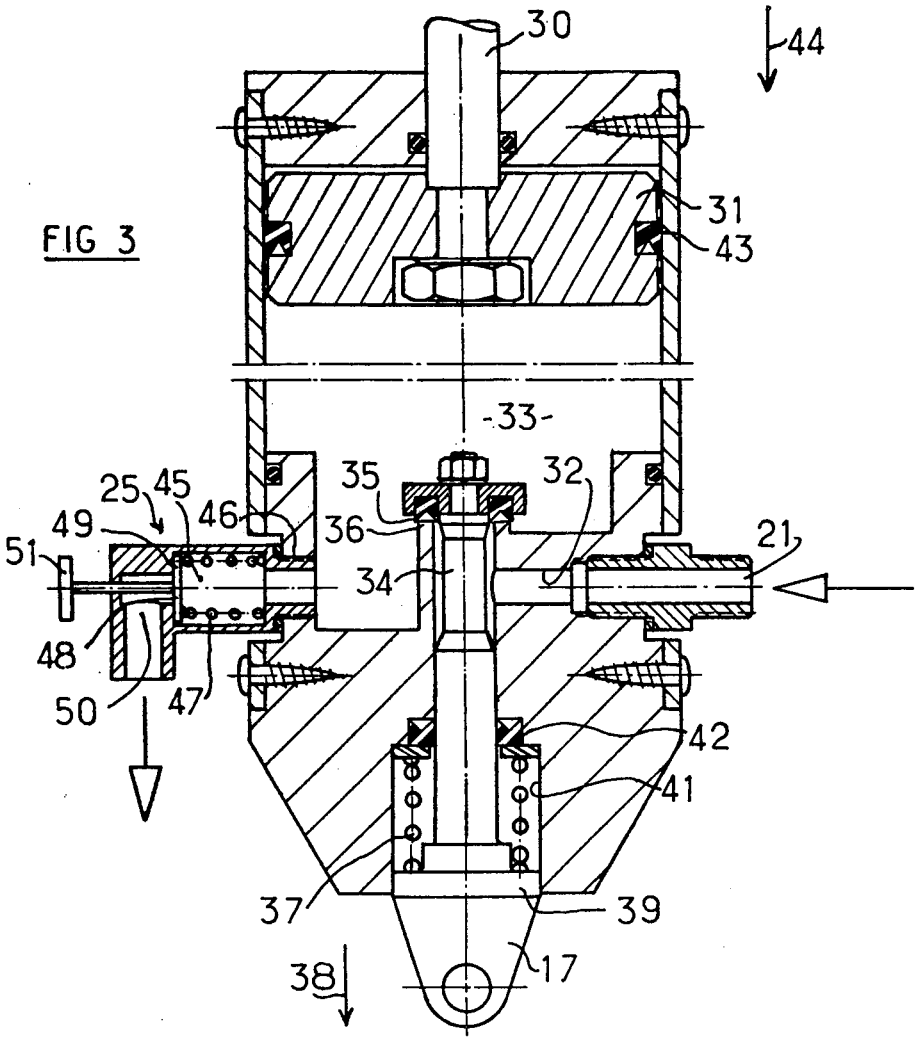
FIG. 3 represents a lengthwise section view at a larger scale performed through the jack that equips the device.
Figure 4:
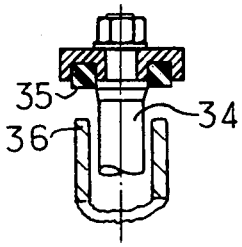
FIG. 4 represents, as in FIG. 3, a stripped view of the position of the supply valve of the jack when the jack is supplied.

Now, one will refer to FIGS. 3 and 4 in which one is shown an especially fortunate implementation mode of the jack 11 enabling a person who wants to leave the bath to control automatically the filling with water of the jack from the handle 13.

In FIG. 3, one sees the articulation 17 at the base of the jack 11, and in 30 the mobile strip which is attached to the piston 31 of the jack.

The water input takes place at the base of the jack chamber 11 through an orifice 32 which communicates with the flexible supply pipe 21. The orifice 32 communicates with the chamber 33 of the jack by way of a slide valve 34 of which the lower tip bears the articulation 17 of the jack. The valve 34 includes at its upper tip a waterproofing lining 35 which comes to bear against the seat 36 which communicates with the orifice 32. The valve is shut by the action of a spring 37 which pulls the valve in the direction of arrow 38 by leaning onto the articulation stand 39 of the valve, the other tip of the spring 37 coming to bear on a washer 40 supported at the bottom of bore 41 formed at the foot of the jack 11. The waterproofing joints or linings 42, 43 ensure that the chamber 33 is waterproof when the jack is under pressure. It is clear that if one presses with sufficient force in the direction of arrow 44 on the upper tip of the jack, or on the strip 30 of the piston 31, one will make the jack unit go down by making it slide on the slide valve 34, by compressing the spring 37. Hence, as illustrated in FIG. 4, one removes the waterproofing lining 35 from the seat 34, thus enabling a supply of water to the chamber 33 and subsequently controlling the extension of the jack and the lifting of the handle 13. This downward pressure on the jack 11 is automatically applied when the person wishing to get out of the bathtub pulls toward him or her the handle 13 by hanging on to it to seek assistance.

On FIG. 3, one also sees an advantageous implementation mode of the emptying device 25 comprised of a spring valve. The device 25 includes a small chamber 45 which screws into a threaded orifice 46 formed at the base of the jack 11 and directed towards the front of the bathtub. Inside the chamber a spring 47 is mounted which usually applies a valve 48 against the side 49 of the chamber 45 that obstructs the emptying orifice 50. The valve 48 is attached to a push button 51. In order to obtain the emptying of the jack and thus the lowering of the handle 13, all that is needed is for the person who is resting inside his or her bathtub to lean on the push button 51.

From the previous description, it is clear that the device of the invention is very simple, reliable and economic in its design, and it can be implemented with the most common materials in the hygienic field, for instance with chromed steel, brass, copper, etc., pipes. The device requires no other special adapting and installation means.

Obviously, there are many variations that can be applied to the implementation mode which has been described and illustrated.

The device can be planned especially so that it can be affixed directly to the edge of the bathtub that it must equip, the bathtub ultimately including special means, for instance two fitting orifices to accommodate the static chassis which will be bolted there.

Moreover, the mobile frame 12 can be designed so that its length can be adjusted with telescoping pipes, for instance, in order to be adjusted to the size of the user.

With respect to severely handicapped people, one can plan a harness instead of the handle 13 which can support the person under the arms, for instance.

Also, the lever arms which ensure assistance for getting out of the bathtub can be installed in ways other than those described, according to the available placement and the lay-out of the facilities. For instance, the jack may be hooked onto the ceiling. In all cases, the important thing is to obtain, with a water supply jack, an adjustable and gradual force which allows a handle or harness to be lifted to which the person can latch onto, the purge being obtained through simple emptying of the jack in the bathtub.

One will also observe that in exceptional cases when water distribution is ensured under too weak a pressure, it is possible to supply the device from a small capacity pressurized water tank, of which the pressure at the desired level can be obtained with a small electric motor, vibrator, etc.

One will now refer to the implementation mode illustrated in FIGS. 6 through 11.

As in the previously described implementation modes, the assistance device includes basically a jack 111 which can be supplied with water under pressure by way of a duct 121 that enables the extending of the jack. The jack is articulated at one of its tips 117 at a static point which is attached to a support plate 105 which will be affixed for instance to the wall (not illustrated) with screws that cross through the openings such as 60, that are shaped inside the plate. At its other tip, the stem of the jack is articulated in 119 around an axis 120 affixed to the tip of a lever 112 which rotates around a pivot 114. In the illustrated implementation mode, as it appears more clearly in FIG. 6, the lever 112 is attached to a ring 61, which is welded to it for instance, that rotates around the pivot 114 with ball bearings 62 for example. On the ring 61 a cap 64 is affixed, for example with two screws 63, and attached, by welding for instance, to the tip of a tubular lever 65 of which the other tip bears the support handle 113.

In an advantageous way, as it appears more clearly in FIGS. 7 through 10, the handle 113 can be lifted by 90 degrees, as illustrated in 113', by being mounted in pivoting fashion at the free tip of the lever 65. As illustrated, the mounting can be carried out by planning for instance a coupling along a certain length l of the handle 113 in the tubular lever 65 and by forming on the facing tips of the lever and the handle toothed sectors such as 66, 67 on the lever 65 and 68, 69 on the tip facing the handle 113 thus enabling a clearance of about 90 degrees of the handle 113 in relation to the mounting axis 70. A pin 71 turning inside two slits 72 formed on a quarter run inside the rectilinear sidewall 73 of the handle 113 completes the assembly.

Therefore, it is possible to restore the handle 113 to the vertical posture against the support side on which the device is mounted in order to conceal it when the device is not operating.

In FIG. 11, one sees the protective hood 74 of the device which covers all of the device organs with the exception of the water supply channels 121, the purging device 125 and the lever 65 that supports the handle 113.

One observes that the lay-out of the device is such that by planning two decoupling plugs 75, 76 inside the hood, it is possible, with a simple inversion of the side of the plate on which the device is mounted, to obtain a left or right fastening unit according to the site.

It is clear that the device can be embedded into the wall, in which case only the lever 65 and the handle 113 are visible, if a niche was planned at the time of assembly or cleared to place the device.

The device includes also in an advantageous way a spring 77 or another equivalent elastic means that facilitates the low repositioning of the device after the waterfill of the jack. The spring can be affixed at a point 78 of the intermediate lever 112 between the axes 119 and 114, and at a static point 79 of the plate. Hence, the lowering of the lever is facilitated by the pressuring of the jack 111, as soon as one has shut off the water supply 121 of the jack and one has opened the emptying faucet 125. One will note that the device can also be used to enter into the bathtub as well as to get out of it. In order to get into the bathtub, the user will place the device in the upper position, at the most appropriate height. He or she will then have to close the water supply 121 and open the emptying mechanism 125, a more or less wide opening that ensures a gradual lowering with more or less speed of the handle to which the user can latch onto.

It appears that the device, which is easily fastened on any kind of wall structure, can be used in any other place besides the bedroom, for instance in the toilet or in a bedroom, to help a handicapped person to use, under safe conditions, a toilet seat or a bed.

Ultimately, the jack activating fluid can be another fluid besides water, for instance compressed air, especially in a hospital room, which is usually equipped with an air circuit under pressure. In that case, the emptying of the jack for allowing air to escape can be done in open air directly into the room atmosphere.

Previously, by referring in particular to FIGS. 3 and 4, we described a device that permits the automatic lifting of the device handle, when after choosing the adequate operating position of the device, the person that wants assistance can take hold of the handle and apply some effort to it.

Now we will describe, by referring to FIGS. 12, 13 and 14, three implementation variations of an automatic mechanism of that sort.

According to the implementation mode illustrated in FIG. 12, similar to the device illustrated in FIGS. 3 and 4, the articulation 117 formed at the base of the jack 111 controls a slide valve 134 for the jack water supply. When no pressure is exerted on the handle 113, the waterproofing lining 135 of the valve 134 is flattened against the seat 136, so that water supply for the chamber 133 of the jack is shut off. The valve 134 is maintained on the seat 136 under the effect of action from the spring 137 from which force is derived so as to generously balance that of the release spring 77 acting by way of the lever 112 in reverse (or in a way that opens the valve).

As in the implementation mode of FIGS. 3 and 4, the user takes hold of the handle 113 and latches onto it with sufficient effort, so that it compresses the spring 137 and opens the valve 134. If the water supply 121 of the jack was previously opened, the jack would then be supplied with water and the handle rises.

The reverse lowering motion of the handle is controlled by the simple opening of the faucet (not illustrated) at 125 which is screwed inside the emptying orifice 146. The lowering action is obtained automatically under the effect of the release spring 77. If one wants to use the device as an aid for a lowering motion, for instance to get inside the bathtub, or to sit down on the toilet, all one has to do is to first close the water supply 121 of the jack, and then to take hold of the handle 113, to hang onto it and to open the emptying faucet 125 to the wanted size in order to obtain the desired gradual lowering speed of the handle.

The implementation mode illustrated in FIG. 13 uses a device which is fairly similar to the one in FIG. 12, to the extent that the slide valve 134' operates in reverse as compared to the one described in FIG. 12.

Indeed, one sees that as assembled, the spring 137 acts, in the absence of pressure on the handle 113, in order to maintain the valve flattened on its low thrust, that is opened, the fitting 135' having been removed from the seat 136'. In other words, if the water supply of the jack is open, in the absence of a pulling motion on the handle 113, the device is always brought to the high position.

If the user takes hold of the handle 113 and latches onto it with sufficient strength so as to lower the jack 111 as indicated by arrow F, the spring 137 is compressed, and in the reverse of what was happening in FIG. 12, the water supply of the chamber 133 of the jack is shut off. Under such circumstances, and those only, the lowering of the handle 113 can be obtained by opening the emptying mechanism 125.

One will also note that this device prevents lifting function of the handle even if the water control of the jack is open, in the event of overload ensuring the compressing of the spring 137. This device can therefore be used as an anti-overload safety device.

We will now describe the implementation mode illustrated in FIG. 14 that shows somewhat a combination of the two safety systems in FIGS. 12 and 13.

As in the system of FIG. 12, the device includes a slide valve 134' which is usually maintained shut on its seat 136 by the action of a spring 137, as long as an application force F with a specific measure is not applied onto the jack 111. Up to then, the water supply of the chamber 133 of the jack is therefore interrupted, even if the supply 121 is open.

The device also includes a second seat 136' for the slide valve 134'' against which the slide valve 134'' acts as a thrust in the end run when the spring 137 is sufficiently compressed. For such compression to correspond to an effort overload, the water supply of the jack is cut off and any successive lifting of the handle is forbidden. The device advantageously includes a second spring 80 which is coaxial to the spring 137 kept compressed under the stand of the jack, for instance by a washer 81 and an inserted tool joint. After the valve 134'' has moved on its mid-run for instance, the stand 139 of the articulation 117 shoves back the washer 81 and compresses the spring 80, which corresponds to a second specific effort threshold. In this way, when the water supply of the jack is open, the device operates automatically in a lifting motion as soon as one hangs onto the handle and applies sufficient strength on it. On the other hand, the device stops when the effort impressed upon the handle becomes too sizeable, exceeding an overload value that can correspond to an inadequate application of the device or to the presence of an alien body found inadvertently behind the lever 65.

In order to empty the device, one realizes that the mechanism operates as previously described.

There are many variations that can be added to the described implementation modes.

Hence, for example, a cable can be affixed to the lever which is activated by the jack of the machine, that will make it possible, by going through release pulleys, affixed for instance to the ceiling of a room, to hook a hanger to which the user can be suspended to help him or her get up or go down.

In a similar fashion, one device and one only can permit the activating of several parallel cables to which hangers will be affixed at various useful places of a room. Hence, a device mounted in a bathroom can activate three hangers respectively at the location of the bathtub, of the toilet seat and of a sink.

Figure 5:
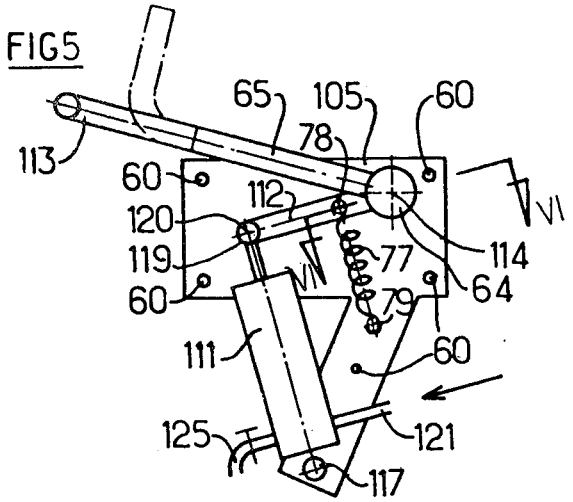
FIG. 5 represents schematically, from the front, the entire device according to said improvements.
Figure 6:
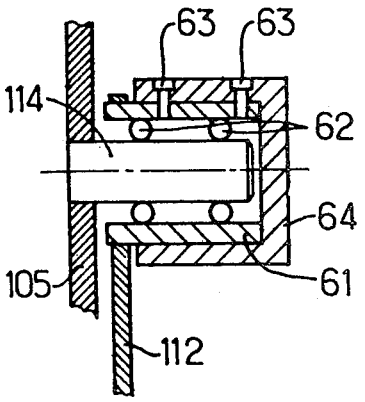
FIG. 6 represents a section view at a larger scale of a detail of the device performed fairly much at the level of plane VI—VI of FIG. 5.

One will note that the devices such as those described in particular in FIGS. 5, 12 and 14 enable an automatic lowering of the lever. Hence, the lever is lowered automatically when the emptying faucet 125 is opened without interrupting the water supply of the jack. This maneuver can be conducted by the person once he or she is in the bathtub if he or she has entered without lowering the lever or without hanging onto it.

I claim:

1. A self-operated support device which helps a person to get out of a bathtub, comprising essentially one water supply jack (11) supplied under pressure with the supply water from the bathtub and one handle (13) (or a harness) set in motion by said jack, characterized in that said handle (13) (or harness) is mounted on a lever (12) hinged towards one of its ends around an axis (14), the rotating of said lever (12) being controlled by said jack which exerts force, at one end (19) thereof, on said lever, the other jack end (17) being hinged thus allowing the conjugated hinging motions of said lever (12) and said jack(11).

2. A device according to claim 1 characterized in that the water supply under pressure of the jack (11) is achieved with a flexible duct (21) mounted on the usual supply of a shower and a check-valve is mounted onto a water supply intake (32) of the jack (11).

3. A device according to claim 1, characterized in that the emptying of said jack (11) is planned at the low part of the device in a spot which is easily accessible to the person who is resting inside the bathtub when the device is in the lifted position.

4. A device according to claim 1, characterized in that the handle (13) or the harness is affixed to a mobile frame (12) which is articulated at one of its tips around an axis (14) that is supported by a static chassis or equivalent (5) and articulated at a specific distance from said axis at a first tip (19) of said jack (11) of which the other tip is articulated in (17) on said static or equivalent chassis (5).

5. A device according to claim 4, characterized in that the water intake is conducted through an opening (32) formed at the base of the jack (11) leading to the pressure chamber (33) of the jack through a slide valve (34) which is usually kept closed on its seat (36) by a spring (37) or equivalent which opens when one compresses said spring (37) or equivalent by hanging onto said handle (13) or said harness.

6. A device according to claim 5, characterized in that said slide valve (34) is mounted onto the base of said jack (11) according to its axis and its tip which protrudes under the jack forms articulation (17) of the jack on said static or equivalent chasses (5);in a non-use position, the slide valve (34) is shut by being kept on its seat (36); in the use position, the slide valve (34) is open by being removed from its seat (36), the articulation being pushed in as far as possible inside the jack.

7. A device according to claim 3, characterized in that the emptying of the jack is conducted with a flap or valve (25) mounted on the base of the jack, kept usually closed by a spring (47) or equivalent.

8. A device according to claim 1, characterized in that a pressure reducer is mounted on the water supply intake (32) of the jack (11).

9. An self operated aid device for helping a person to get up or to go down, especially in the use of a bathtub, which includes basically a jack (111), gripping means such as a handle (113) or a harness and means to control from said jack the lifting and lowering on an automatic scale of said gripping means, said device characterized in that the handle (113) or the harness is mounted at the tip of a lever (65) of which the other tip is connected to the rotating axis (114) of a second lever (112) controlled in a rotation motion by being articulated at a specific distance from said axis (114) to a first tip (119) of the jack (111) of which the other tip is articulated at a static point (117).

10. A device according to claim 9, characterized in that said jack (111) and said second lever (112) are articulated respectively around said static axes (114, 117) on a plate (105) for support and fastening of the entire device.

11. A device according to claim 10, characterized in that said handle (113) lifts up in the vertical position, freely in a non-use posture of the device by rotating in one quarter run around the free tip of said first lever (65) and falls back fairly horizontally by reverse rotation jammed in thrust position for the device assistance posture.

12. A device according to claim 9, characterized in that a release spring (77) assists in the recall motion of the device by emptying the jack, affixed to one of its tips at a static point (79) of said plate (105) and at the other tip to said second lever (65) at an intermediate point (78) between the lever articulation axis (114) and the jack articulation axis (111) on said lever.

13. A device according to claim 9, characterized in that the water intake controlled by a faucet, a valve or equivalent is performed through an orifice (132) formed at the base of the jack (111) leading inside the pressure chamber (133) of the jack by a slide valve (134') kept usually open on its seat (136') by a spring (137) or equivalent which closes down when one compresses said spring (137) or equivalent following an effort exerted on said handle (113) or said harness and exceeding a specific value.

14. A device according to claim 13, characterized in that said slide valve (134') is mounted on the base of said jack (111) according to its axis, and its tip which protrudes under the jack forms an articulation (117) of the jack on said plate (105); in a normal position, the slide valve (134') is open by being kept away from its seat (136'), the articulation (117) protruding optimally under the jack; in a position requiring excessive effort, the slide valve (134') is shut by being clamped onto its seat (136'), the articulation pushed as deep inside the jack as possible.

15. A device according to claim 9, characterized in that the water intake is performed through an orifice (132) which is formed at the base of the jack (111) that leads inside the pressure chamber (133) of the jack with a slide valve (134") that is usually kept shut on a first seat (136) with a first spring (137) that opens when one compresses said spring and that closes against a second seat (136') by compressing more said first spring (137) when said effort exceeds a particular threshold.

16. A device according to claim 15, characterized in that said first spring (137) is assisted by a second spring (80) which is compressed when said effort reaches or exceeds said threshold.

17. A device according to claim 15 or claim 16, characterized in that said slide valve (134") is mounted at the base of said jack (111) according to its axis and its tip which protrudes under the jack forms an articulation (117) of the jack on said plate (105); in an initial position of use, the valve (134") is closed by being kept on its first seat (136) by said spring (137); in a standard position of use, the valve (134") is open by being kept away from said seat (136) through average compression of said first spring (137); in a final position or of overload of the device, the valve (134") is closed by being kept on its second seat (136') through compression of said second spring (80) and/or more complete compression of said first spring (137).

18. A self-operated support device which helps a person to get out of a bathtub, comprising essentially one water supply jack (11) supplied under pressure with the supply water from the bathtub and one handle (13) set in motion by said jack, characterized in that said handle (13) (or harness) is mounted on a lever (12) hinged around an axis (14), the rotating of said lever (12) being controlled by said jack which exerts force on said lever, the supply and pressure activation of said jack (11) being controlled by applying a minimum pressure onto said handle.

* * * * *